US007321225B2

(12) United States Patent
Garlapati et al.

(10) Patent No.: US 7,321,225 B2
(45) Date of Patent: Jan. 22, 2008

(54) VOLTAGE REFERENCE GENERATOR CIRCUIT USING LOW-BETA EFFECT OF A CMOS BIPOLAR TRANSISTOR

(75) Inventors: Akhil K. Garlapati, Boston, MA (US); Bruce P. Del Signore, Hollis, NH (US); David Pietruszynski, Austin, TX (US)

(73) Assignee: Silicon Laboratories Inc., Austin, TX (US)

( * ) Notice: Subject to any disclaimer, the term of this patent is extended or adjusted under 35 U.S.C. 154(b) by 284 days.

(21) Appl. No.: 10/813,837

(22) Filed: Mar. 31, 2004

(65) Prior Publication Data

US 2005/0218879 A1 Oct. 6, 2005

(51) Int. Cl.
*G05F 3/16* (2006.01)

(52) U.S. Cl. ..... 323/313; 323/316; 327/540

(58) Field of Classification Search ..... 323/312–316, 323/907, 909; 327/536–541
See application file for complete search history.

(56) References Cited

U.S. PATENT DOCUMENTS

| | | | | |
|---|---|---|---|---|
| 4,588,941 | A | 5/1986 | Kerth et al. | |
| 4,603,291 | A * | 7/1986 | Nelson | 323/315 |
| 4,857,823 | A | 8/1989 | Bitting | |
| 5,001,362 | A | 3/1991 | Tran | |
| 5,034,626 | A | 7/1991 | Pirez et al. | |
| 5,132,556 | A | 7/1992 | Cheng | |
| 5,349,286 | A | 9/1994 | Marshall et al. | |
| 5,430,367 | A | 7/1995 | Whitlock et al. | |
| 5,488,329 | A | 1/1996 | Ridgers | |
| 5,563,502 | A * | 10/1996 | Akioka et al. | 323/313 |
| 5,568,045 | A * | 10/1996 | Koazechi | 323/314 |
| 5,666,046 | A * | 9/1997 | Mietus | 323/313 |
| 5,796,244 | A | 8/1998 | Chen et al. | |
| 5,818,294 | A | 10/1998 | Ashmore, Jr. | |
| 5,900,773 | A | 5/1999 | Susak | |
| 5,949,225 | A * | 9/1999 | Sawtell | 323/284 |
| 6,002,243 | A | 12/1999 | Marshall | |
| 6,031,365 | A | 2/2000 | Sharpe-Geisler | |
| 6,052,020 | A | 4/2000 | Doyle | |
| 6,075,407 | A | 6/2000 | Doyle | |
| 6,160,391 | A | 12/2000 | Banba | |

(Continued)

FOREIGN PATENT DOCUMENTS

JP 1292411 11/1989

OTHER PUBLICATIONS

Allen et al., "Current and Voltage References," *CMOS Analog Circuit Design*, 1987, pp. 240-252.

(Continued)

*Primary Examiner*—Rajnikant B. Patel
(74) *Attorney, Agent, or Firm*—Zagorin O'Brien Graham LLP

(57) ABSTRACT

A voltage reference generator has been discovered that generates a stable reference voltage that is less than the bandgap voltage of silicon for power supply voltages less than 2V, yet provides sufficient voltage headroom to operate a cascaded current mirror. In one embodiment, the voltage reference generator has a power supply rejection ratio of at least 60 dB and has improved noise performance as compared to traditional bandgap circuits. These advantages are achieved by leveraging the low-beta effect of a CMOS bipolar transistor to generate a current proportional to an absolute temperature.

43 Claims, 3 Drawing Sheets

U.S. PATENT DOCUMENTS

| | | | | |
|---|---|---|---|---|
| 6,198,267 | B1 * | 3/2001 | Bakker et al. | 323/316 |
| 6,366,071 | B1 | 4/2002 | Yu | |
| 6,727,744 | B2 | 4/2004 | Nagaya | |
| 6,799,889 | B2 * | 10/2004 | Pennock | 374/178 |
| 6,930,538 | B2 | 8/2005 | Chatal | |

OTHER PUBLICATIONS

Allen et al., "CMOS Analog Circuits and Systems," *CMOS Analog Circuit Design*, 1987, pp. 589-599.

Banba et al., "A CMOS Bandgap Reference Circuit with Sub-1-V Operation," IEEE Journal of Solid-State Circuits, vol. 34, No. 5, May 1999, pp. 670-674.

de Langen et al., "Compact Low-voltage PTAT-Current Source and Bandgap-Reference Circuits," Delft Institute for MicroElectronics and Submicron technology (DIMES), pp. 108-111.

Gray et al., "Band-Gap-Referenced Biasing Circuits," *Analysis and Design of Analog Integrated Circuits*, Third Edition, 1993, pp. 338-346.

Lee, "Bandgap References in CMOS Technology," *The Design of CMOS Radio-Frequency Integrated Circuits*, 1998, pp. 233-235.

Razavi, "Bandgap Reference," *Design of Analog CMOS Integrated Circuits*, 2001, pp. 384-392.

Phang et al., "Low Voltage, Low Power CMOS Bandgap References," ECE 1352, University of Toronto, pp. 1-17.

Kuijk, Karel E., "A Precision Reference Voltage Source," IEEE Journal of Solid-State Circuits, vol. SC-8, No. 3, Jun. 1973, pp. 222-226.

* cited by examiner

VOLTAGE REFERENCE GENERATOR CIRCUIT USING LOW-BETA EFFECT OF A CMOS BIPOLAR TRANSISTOR

CROSS-REFERENCE TO RELATED APPLICATION(S)

BACKGROUND

1. Field of the Invention

The present invention relates to generating a reference voltage in integrated circuits, and more particularly to reference voltage circuits for low-power applications.

2. Description of the Related Art

A bangap reference circuit has improved temperature stability and is less dependent on power supply voltage than other known voltage reference circuits. Bandgap reference circuits typically generate a reference voltage approximately equal to the bandgap voltage of silicon extrapolated to zero degrees Kelvin, i.e., $V_{G0}$=1.205V. Typical voltage reference circuits include a current mirror coupled to the power supply and the voltage reference node to provide a current proportional to the absolute temperature to the voltage reference node.

Integrated circuits having 3V power supplies can easily meet the demands of operating devices included in a cascoded current mirror and generate the reference voltage without compromising stability of the reference voltage. For example, a voltage reference generator with a power supply of 3V provides a reference voltage of 1.2V. The $V_{DS}$ of a MOSFET included in the current mirror has a magnitude of 3V−1.2V=1.8V, which is sufficient to operate the device under typical conditions with an acceptable power supply rejection ratio (PSRR) (i.e., the ability of the voltage reference generator to reject noise on the power supply). However, as the power supply voltage drops, e.g., for low-power applications, available voltage headroom required to operate the devices included in the current mirror is reduced, the PSRR becomes more critical, and the voltage reference generator is less likely to provide a sufficiently stable reference voltage with respect to variations on the power supply.

Accordingly, improved techniques for generating stable reference voltages for low-power applications are desired.

SUMMARY

A voltage reference generator has been discovered that generates a stable reference voltage that is less than the bandgap voltage of silicon for power supply voltages less than 2V, yet provides sufficient voltage headroom to operate a current mirror. In one embodiment, the voltage reference generator has a power supply rejection ratio of at least 60 dB and has improved noise performance as compared to traditional bandgap circuits. These advantages are achieved by leveraging the low-beta effect of a bipolar transistor formed in a CMOS process to generate a current proportional to an absolute temperature.

In some embodiments of the present invention, a voltage reference generator includes a bipolar transistor configured to amplify a base current of the bipolar transistor, the base current being proportional to an absolute temperature. The base current may be proportional to a voltage difference between two base-emitter voltages biased at different current densities, the voltage difference formed across a resistor coupled to the base of the bipolar transistor. A reference voltage produced by the voltage reference generator may be proportional to a parabolic function of temperature.

In some embodiments of the present invention, an integrated circuit includes a first bipolar transistor, a second bipolar transistor, and a resistor coupled to a base of the second bipolar transistor. A voltage difference between a base-emitter voltage of the first bipolar transistor and a base-emitter voltage of the second bipolar transistor forms across the resistor. A voltage reference node receives a voltage based at least in part on the voltage difference.

In some embodiments of the present invention, a method includes developing a base current of a first bipolar transistor. The base current is proportional to absolute temperature. The method includes amplifying the base current. The method includes generating a reference voltage based at least in part on the amplified base current. The base current may be proportional to a voltage difference between a base-emitter voltage of a second bipolar transistor and a base-emitter voltage of the first bipolar transistor. The voltage difference may be formed across a first resistor coupled to a base of the first bipolar transistor.

In some embodiments of the present invention, a method of manufacturing an integrated circuit includes forming a first bipolar transistor, a second bipolar transistor, and a resistor coupled to a base of the second bipolar transistor. A voltage difference between a base-emitter voltage of the first bipolar transistor and a base-emitter voltage of the second bipolar transistor forms across the resistor. The method includes forming a voltage reference node that receives a voltage based at least in part on the voltage difference.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DESCRIPTION OF THE PREFERRED EMBODIMENT(S)

Figure 1:
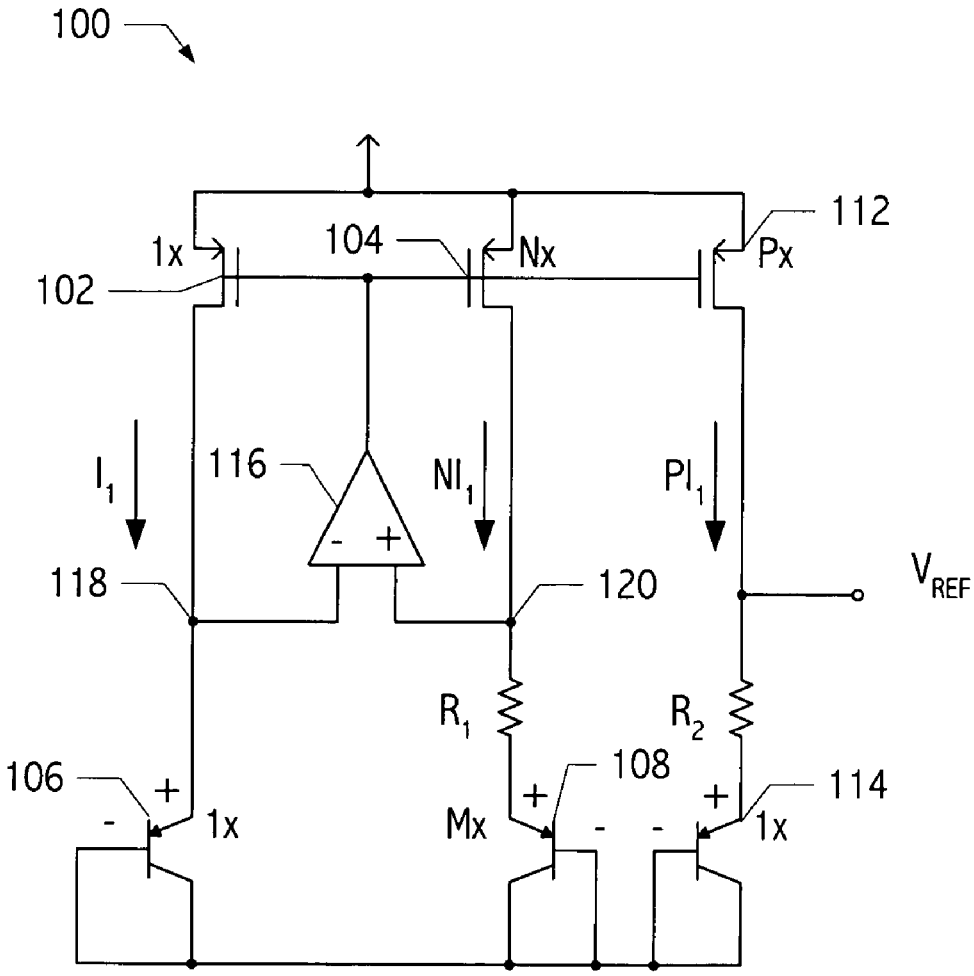
FIG. 1 illustrates a voltage reference generator circuit.

A typical voltage reference circuit (e.g., voltage reference generator 100 of FIG. 1) is designed to provide a temperature stable reference voltage (i.e., $V_{REF}$). In general, voltage reference circuits take advantage of two electrical characteristics to achieve the desired $V_{REF}$: the $V_{BE}$ of a bipolar transistor is nearly complementary to absolute temperature, e.g., $V_{BE}$=(−1.5 mV/°K*T+1.22)V, and $V_T$ is proportional to absolute temperature, i.e, $V_T$=kT/q.

A voltage proportional to absolute temperature (i.e., a ptat voltage) may be obtained by taking the difference between two $V_{BE}$S biased at different current densities:

$$\Delta V_{BE} = V_T \ln\left(\frac{J_1}{J_2}\right),$$

where $J_1$ and $J_2$ are saturation currents of corresponding bipolar transistors. Accordingly, voltage reference circuit 100 includes a pair of pnp bipolar transistors (i.e., transistors 106 and 108) that are connected in a diode configuration (i.e., the collectors and bases of these transistors are coupled together) and coupled to ground. Transistor 108 has an area that is M times larger than the area of transistor 106. Thus, the saturation currents of transistor 108 and transistor 106 vary by a factor of M. The emitter of transistor 106 is coupled to an inverting input of operational amplifier 116. The emitter of transistor 108 is coupled, via resistor $R_1$, to the non-inverting input of operational amplifier 116. Operational amplifier 116 maintains equivalent voltages at nodes 118 and 120, i.e., $V_{118}=V_{120}=V_{BE106}$. Hence, the difference between $V_{BE106}$ and $V_{BE108}$ (i.e., $\Delta V_{BE106,108}$) forms across resistor $R_1$. Operational amplifier 116 and transistors 102 and 104 convert this voltage difference into a current (i.e., current $I_1$) proportional to the voltage difference:

$$I_1 = \frac{\Delta V_{BE106,108}}{NR_1} = \frac{V_T \ln\left(\frac{M}{N}\right)}{NR_1}$$

Since the thermal voltage $V_T$ has a positive temperature coefficient of k/q, $k=1.38*10^{-23}$J/K and $q=1.6*10^{-19}$C, the current proportional to the voltage difference is proportional to an absolute temperature, i.e., $I_1$ is a 'ptat' current.

Transistor 114 provides a voltage nearly complementary to absolute temperature (i.e., a 'ctat' voltage) because the $V_{BE}$ of a bipolar transistor is nearly complementary to absolute temperature. By compensating the ptat current with a ctat voltage, transistors 102, 104, 106, 108, 112, and 114, and resistors $R_1$ and $R_2$, may be appropriately sized to generate a particular reference voltage output having a zero temperature coefficient:

$$\frac{V_{REF} - V_{BE114}}{R_2} = PI_1;$$

$$V_{REF} = V_{BE114} + PI_1 R_2;$$

$$V_{REF} = V_{BE114} + \frac{PR_2 V_T \ln\left(\frac{M}{N}\right)}{NR_1};$$

$$\frac{dV_{REF}}{dT} = \frac{dV_{BE114}}{dT} + \frac{PR_2 k \ln\left(\frac{M}{N}\right)}{NR_1 q}.$$

Setting $$\frac{dV_{REF}}{dT} = 0,$$

for $V_{REF}$ to have a zero temperature coefficient, $$\frac{PR_2 k \ln\left(\frac{M}{N}\right)}{NR_1 q} = -\frac{dV_{BE114}}{dT} = \frac{1.5\ \text{mV}}{°\text{K}}.$$

$V_{BE114}=V_{BE106}=0.74$ at 300°K for an exemplary process and choosing M=8, N=¼P/N~4, and $R_2/R_1$~1.2:

$$V_{REF} = V_{BE114} + \frac{PR_2 V_T \ln\left(\frac{M}{N}\right)}{NR_1};$$

$$V_{REF} = 0.74\ \text{V} + \frac{1.5\ \text{mV}}{°\text{K}} T;$$

at 300° K, $V_{REF}$=0.74V+0.45V=1.19V≈1.2V.

$V_{REF}$ is approximately equal to, $V_{G0}$=1.205V, i.e., the bandgap voltage of silicon extrapolated to zero degrees Kelvin.

When the power supply is 3V, the VDS of transistor 112 has a magnitude of 3V−1.2V=1.8V, which is sufficient to operate the device to provide a current independent of fluctuations in VDS. Thus power supply noise will have minimal effect on $I_1$. However, for an exemplary low-power application, the power supply voltage is 1.62V. Voltage reference generator 100 provides only a VDS of 0.42V for device 112. Transistor 112 may be operating in a linear/quasi-saturation current region and noise on the power supply will cause significant noise in $PI_1$, thereby generating a noisy $V_{REF}$ and degrading the accuracy of $V_{REF}$. The PSRR is typically determined empirically by presenting a varying signal on the power supply and measuring variations exhibited at the $V_{REF}$ node. At a 1.62V power supply, voltage reference generator 100 is unable to provide a desired 60 dB PSRR. The poor power supply rejection of voltage reference generator 100 makes voltage reference generator 100 inoperable for the purpose of providing a stable voltage reference. A desired voltage reference generator PSRR for a low-power application is at least 60 dB over process and temperature variations. In addition, noise from operational amplifier 116, which dominates the circuit noise of voltage reference generator 100, is amplified by the current mirror thus amplifying noise on $V_{REF}$.

Figure 2:
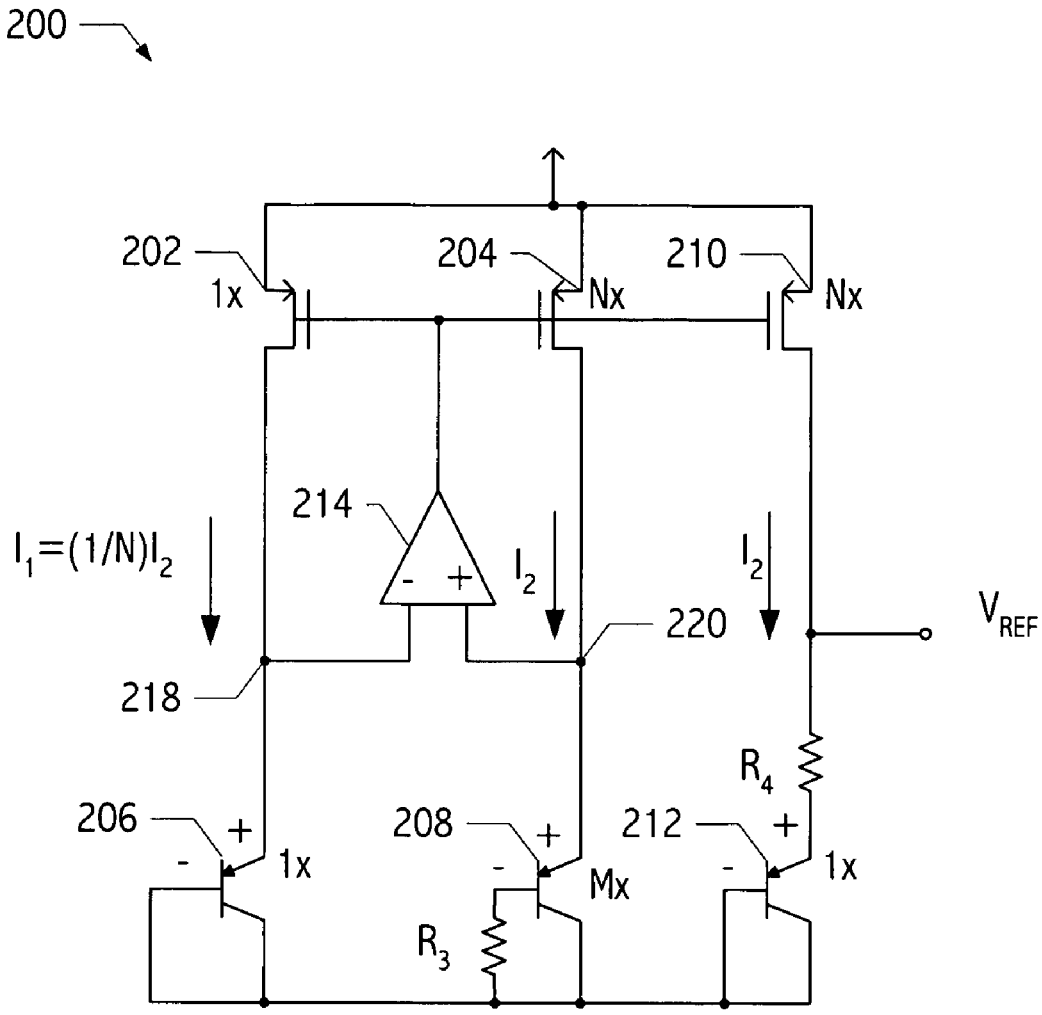
FIG. 2 illustrates a voltage reference generator circuit in accordance with some embodiments of the present invention.
Figure 3:
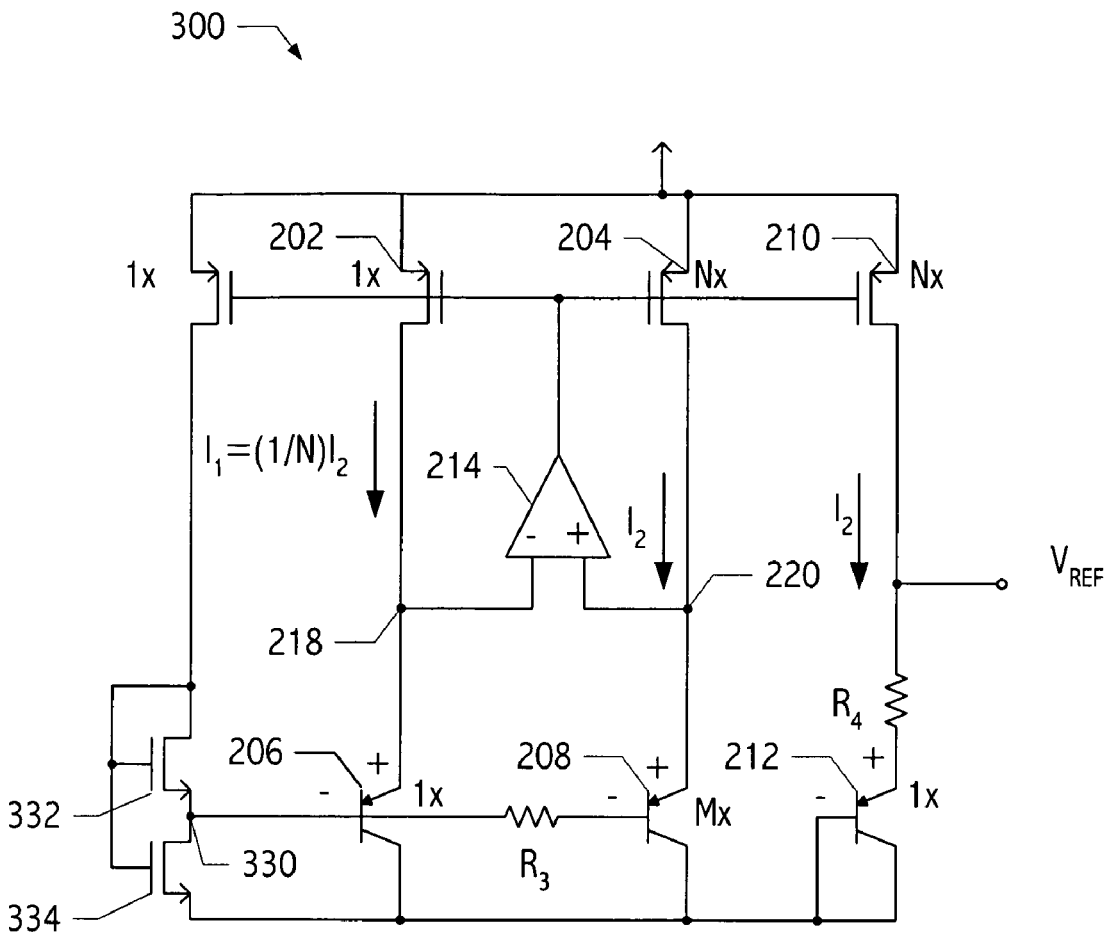
FIG. 3 illustrates a voltage reference generator circuit in accordance with some embodiments of the present invention.

Referring to FIG. 2, voltage reference generator 200 improves the power supply rejection ratio and noise performance of voltage reference generator 100 by removing emitter resistor $R_1$ of voltage reference generator 100 and instead, including base resistor $R_3$. Voltage reference circuit 200 includes a bipolar transistor (i.e., transistor 206) that is coupled in a diode configuration and coupled to ground. A second pnp bipolar transistor (i.e., transistor 208) is configured as an amplifier. Referring to FIG. 3, in another embodiment of the present invention, instead of coupling the base of transistor 206 to ground, transistor 206 may be coupled to node 330 and biased by transistors 332 and 334. Similarly, base resistor $R_3$ may be coupled to node 330 to receive the bias voltage generated by transistors 332 and 334.

Referring back to FIG. 2, transistor 208 has an area that is M times larger than the area of transistor 206. Thus, the saturation currents of transistor 208 and transistor 206 vary by a factor of M. The emitter of transistor 206 is coupled to an inverting input of operational amplifier 214. The emitter of transistor 208 is coupled to the non-inverting input of operational amplifier 214. Operational amplifier 214 maintains equivalent voltages at nodes 218 and 220, i.e., $V_{218}=V_{220}=V_{BE206}$. Hence, the difference between $V_{BE206}$ and $V_{BE208}$, i.e., $\Delta V_{BE206,208}$, forms across resistor $R_3$:

$$I_{B208} = \frac{V_{BE206} - V_{BE208}}{R_3} \text{ and}$$

-continued $$\begin{aligned} I_2 &= I_{E208} \\ &= (\beta_{208}+1)I_{B208} \\ &= (\beta_{208}+1)\frac{V_{BE206}-V_{BE208}}{R_3} \\ &= (\beta_{208}+1)\frac{V_T\ln\left(\frac{M}{N}\right)}{R_3}, \end{aligned}$$

where $N=W_{204}/W_{202}$, $W_{204}$ being the width of transistor 204 and $W_{202}$ being the width of transistor 202 and the channel lengths of transistor 204 and transistor 202 being substantially equal. Since the thermal voltage $V_T$ has a positive temperature coefficient k/q, the current proportional to the voltage difference is proportional to an absolute temperature, i.e., $I_2$ is a ptat current.

Transistor 212 provides a ctat voltage, $V_{BE212}$. By compensating the ptat current with a ctat voltage, transistors 202, 204, 206, 208, and 212, and resistors R and $R_2$, may be appropriately sized to generate a substantially constant reference voltage output, i.e., $V_{REF}$:

$$\frac{V_{REF}-V_{BE212}}{R_4} = I_2$$

$$V_{REF} = V_{BE212} + I_2R_4$$

$$V_{REF} = V_{BE212} + (\beta_{208}+1)\frac{R_4V_T\ln\left(\frac{M}{N}\right)}{R_3}.$$

In other embodiments, a ctat current may be formed and summed with $I_2$ to create a substantially constant current. For a supply voltage of 1.62V and a target reference voltage of 0.96V, the following parameters are chosen: M=8, N=¼, $R_3$=16 kΩ, $R_4$=5.5 kΩ. Note that the beta of a bipolar transistor has a dependence on temperature. In an exemplary process, the quantity β+1 is ($9.6*10^{-3}T+0.152$) and $V_{BE212}$ is ($-1.4*10^{-3}T+1.118$)V. Thus $V_{REF}$ may be modeled as a quadratic function of temperature:

$$V_{REF}=aT^2+bT+c,$$

where a, b, and c are greater than zero. In general, a, b, and c are determined according to target process technology, supply voltage, and reference voltage. Note that in a typical CMOS process, parasitic substrate pnp transistors (e.g., in the case of an n-well process) and parasitic substrate npn transistors (e.g., in the case of a p-well process) may be used as bipolar transistors. These transistors have a low-beta (e.g., β<10) as compared to transistors formed in a bipolar process (e.g., β>100). Thus currents produced by amplifying a base current of the CMOS bipolar transistor are manageable by typical CMOS devices.

Voltage reference generator 200 benefits from the low-beta of parasitic bipolar transistors by reducing noise on $V_{REF}$. In voltage reference generator 100, transistors 104 and 110 amplify the ptat current, i.e., current $NI_1$ is amplified by P/N, which is approximately 4, thus amplifying the noise contributions of the operational amplifier on $V_{REF}$. In voltage reference 200, the ptat current, i.e., current $I_2$, is generated by amplifying the base current of transistor 208, which is a ptat current. Current $I_2$ itself is not amplified, thus the noise of the operational amplifier is not amplified and noise performance of voltage reference generator 200 is significantly improved as compared to voltage reference generator 100.

Although the reference voltage has a non-zero temperature coefficient, total variation of the reference voltage over the combination of variations in process and in temperature is less than for voltage reference generator 100. The effect on β of variations in process counteract the effect of variations in process on $V_{BE}$ of the bipolar transistor and decreases the overall effect of process variations on voltage reference generator 200. The decrease in variations in $V_{REF}$ for voltage reference generator 200 as a function of process is greater than the increase in variation as a function of temperature. Thus, voltage reference generator 200 has overall reduced variations in $V_{REF}$ as compared to variations in VREF for voltage reference generator 100 over process and temperature. At 1.62V, the PSRR of an exemplary voltage reference generator 200 is 60 dB over all process and temperature conditions, and 70 dB at nominal process and temperature conditions.

In some exemplary applications, it may be advantageous to generate a $V_{REF}$ that varies with temperature. The ratio of $R_4/R_3$ may be adjusted to provide a slope appropriate to the typical application by strategically positioning the center of the parabola. For example, by appropriately positioning a vertex of the parabola, the slope of $V_{REF}$ as a function of temperature may be adjusted to generate a $V_{REF}$ that always increases or always decreases as a function of temperature under particular operating conditions. The exemplary embodiment of circuit 200 was designed for a supply voltage of 1.62V and a reference voltage of 0.96V, however, this circuit is not limited thereto. Voltage reference generator 200 may be operated at lower supply voltages and reference voltages, and remains operable so long as $V_{DD}-V_{REF}>400$ mV (i.e., the current mirror remains operable).

While circuits and physical structures are generally presumed, it is well recognized that in modern semiconductor design and fabrication, physical structures and circuits may be embodied in computer readable descriptive form suitable for use in subsequent design, test, or fabrication stages. Accordingly, claims directed to traditional circuits or structures may, consistent with particular language thereof, read upon computer readable encodings and representations of same, whether embodied in media or combined with suitable reader facilities to allow fabrication, test, or design refinement of the corresponding circuits and/or structures. Structures and functionality presented as discrete components in the exemplary configurations may be implemented as a combined structure or component. The invention is contemplated to include circuits, systems of circuits, related methods, and computer-readable medium encodings of such circuits, systems, and methods, all as described herein, and as defined in the appended claims. As used herein, a computer readable medium includes at least disk, tape, or other magnetic, optical, semiconductor (e.g., flash memory cards, ROM), or electronic medium and a network, wireline, wireless or other communications medium.

What is claimed is:

1. A voltage reference generator comprising:

a first bipolar transistor configured to amplify a base current of the first bipolar transistor, the base current being proportional to an absolute temperature, a resistor coupled to the base of the first bipolar transistor, the base current being proportional to a voltage difference between two base-emitter voltages of bipolar transistors configured to have different current densities, the voltage difference being formed across the resistor coupled to the base and the base current being at least partially based on a resistance of the resistor coupled to the base, and a current mirror circuit configured to mirror a first current at least partially based on the amplified base current and configured to provide the mirrored current to a voltage reference node.

2. A voltage reference generator comprising:

a first bipolar transistor configured to amplify a base current of the first bipolar transistor, the base current being proportional to an absolute temperature, and a resistor coupled to the base of the first bipolar transistor, wherein the base current is proportional to a voltage difference between two base-emitter voltages of bipolar transistors configured to have different current densities, the voltage difference being formed across the resistor, wherein a reference voltage produced by the voltage reference generator is proportional to a parabolic function of temperature.

3. The voltage reference generator, as recited in claim 1, wherein a power supply coupled to the voltage reference generator is less than 1 .7V.

4. The voltage reference generator, as recited in claim 3, wherein a power supply rejection ratio of the voltage reference generator is at least 60 dB.

5. The voltage reference generator, as recited in claim 1, wherein a reference voltage generated by the voltage reference generator is less than the bandgap voltage of silicon.

6. The voltage reference generator, as recited in claim 1, comprising:

a second bipolar transistor, providing one of the two base-emitter voltages; and a voltage reference node receiving a voltage based at least in part on the first current.

7. The voltage reference generator, as recited in claim 6, wherein the first bipolar transistor provides the other of the two base-emitter voltages, and the second bipolar transistor operates at a current density different from the current density of the first bipolar transistor.

8. The voltage reference generator, as recited in claim 6, wherein the first bipolar transistor is a low-beta transistor.

9. The voltage reference generator, as recited in claim 8, wherein beta is less than ten.

10. The voltage reference generator, as recited in claim 8, wherein beta is less than five.

11. The voltage reference generator, as recited in claim 6, further comprising:

a circuit coupled to the voltage reference node, the circuit generating a first voltage, the first voltage being proportional to a complement of the absolute temperature.

12. The voltage reference generator, as recited in claim 6, further comprising:

an operational amplifier maintaining effective equivalence of a voltage on a node coupled to the first bipolar transistor and a node coupled to the second bipolar transistor.

13. The voltage reference generator, as recited in claim 12, wherein a noise component on the voltage reference node is substantially equivalent to noise of the operational amplifier.

14. The voltage reference generator, as recited in claim 6, wherein the integrated circuit includes a maximum of one feedback path.

15. The voltage reference generator, as recited in claim 1, wherein the current mirror mirrors the first current without substantially amplifying the first current.

16. The voltage reference generator, as recited in claim 6, wherein the voltage is proportional to a parabolic function of temperature.

17. The voltage reference generator, as recited in claim 16, wherein the resistor has a value adjusting an effective slope of the reference voltage as a function of temperature.

18. The voltage reference generator, as recited in claim 6, wherein a power supply coupled to the voltage reference node is less than 1.7V.

19. The voltage reference generator, as recited in claim 18, wherein the power supply rejection ratio is at least 60 dB.

20. The voltage reference generator, as recited in claim 6, wherein the voltage is less than the bandgap voltage of silicon.

21. A method for generating a reference voltage comprising:

developing a base current of a first bipolar transistor, the base current being proportional to absolute temperature;

amplifying the base current;

the base current being proportional to a voltage difference between a base-emitter voltage of a second bipolar transistor and a base-emitter voltage of the first bipolar transistor, the voltage difference being formed across a first resistor coupled to a base of the first bipolar transistor, the base current being at least partially based on a resistance of the first resistor;

mirroring a first current at least partially based on the amplified base current; and generating a reference voltage at least partially based on the minored current.

22. A method for generating a reference voltage comprising:

developing a base current of a first bipolar transistor, the base current being proportional to absolute temperature;

amplifying the base current; and generating a reference voltage based at least in part on the amplified base current, wherein the base current is proportional to a voltage difference between a base-emitter voltage of a second bipolar transistor and a base-emitter voltage of the first bipolar transistor, the voltage difference being formed across a first resistor coupled to a base of the first bipolar transistor, wherein the reference voltage is proportional to a parabolic function of temperature.

23. The method, as recited in claim 22, further comprising:

adjusting an effective slope of the reference voltage as a function of temperature according to the first resistor.

24. The method, as recited in claim 21, further comprising:

maintaining substantial equivalence of a voltage on a first node and a voltage on a second node with an operational amplifier, the first and second nodes being used to develop the base current.

25. The method, as recited in claim 21, wherein the mirroring has an effective gain of one.

26. The method, as recited in claim 21, wherein the first bipolar transistor is a low-beta transistor.

27. The method, as recited in claim 26, wherein beta is less than ten.

28. The method, as recited in claim 26, wherein beta is less than five.

29. The method, as recited in claim 21, wherein the reference voltage is less than the bandgap voltage of silicon.

30. The method, as recited in claim 21, wherein a power supply coupled to the voltage reference node is less than 1.7V.

31. The method, as recited in claim 30, wherein the power supply rejection ratio is at least 60 dB.

32. An apparatus comprising:

means for developing a current proportional to absolute temperature;

means for generating a reference voltage based at least in part on the current, wherein the means for developing the current proportional to absolute temperature includes a resistor, a first bipolar transistor configured to have a first current density, and a second bipolar transistor configured to have a second current density different from the first current density, wherein a voltage difference between base-emitter voltages of the first and second bipolar transistors is formed across the resistor, the resistor being coupled to the base of the first bipolar transistor, and current through the resistor being substantially equal to the base current of the first bipolar transistor.

33. The apparatus, as recited in claim 32, wherein the reference voltage varies according to a parabolic function of temperature.

34. The apparatus, as recited in claim 32, further comprising:

means for adjusting an effective slope of the reference voltage as a function of temperature.

35. The apparatus, as recited in claim 32, wherein the means for developing the current proportional to absolute temperature includes the means for amplifying current and the means for amplifying provides one of the two base-emitter voltages of bipolar transistors.

36. A voltage reference generator comprising:

a first bipolar transistor configured to amplify a base current of the first bipolar transistor, the base current being proportional to an absolute temperature, wherein a base-collector voltage of the first bipolar transistor equals a voltage difference between two base-emitter voltages biased at different current densities.

37. The method, as recited in claim 21, wherein the first and second bipolar transistors are configured to have different current densities.

38. The voltage reference generator, as recited in claim 36, wherein a reference voltage generated by the voltage reference generator varies according to a parabolic function of temperature.

39. The voltage reference generator, as recited in claim 1, wherein the base current is inversely proportional to the resistance of the resistor.

40. The voltage reference generator, as recited in claim 1, wherein the resistor is coupled between the base of the first bipolar transistor and a power supply node.

41. The voltage reference generator, as recited in claim 6, wherein the first bipolar transistor provides the other of the two base-emitter voltages and the first and second bipolar transistors are pnp transistors configured in common-collector configurations.

42. The voltage reference generator, as recited in claim 41, wherein the resistor is coupled between the base of the first bipolar transistor and the base of the second bipolar transistor.

43. The voltage reference generator, as recited in claim 42, wherein the base of the second bipolar transistor is coupled to a voltage bias node.

* * * * *

UNITED STATES PATENT AND TRADEMARK OFFICE

CERTIFICATE OF CORRECTION

PATENT NO. : 7,321,225 B2
APPLICATION NO. : 10/813837
DATED : January 22, 2008
INVENTOR(S) : Akhil K. Garlapati et al.

It is certified that error appears in the above-identified patent and that said Letters Patent is hereby corrected as shown below:

Col. 8, line 32, please replace "minored" with --mirrored--

Signed and Sealed this

Sixth Day of May, 2008

JON W. DUDAS
*Director of the United States Patent and Trademark Office*